US007666294B2

(12) United States Patent
Bauldreay et al.

(10) Patent No.: US 7,666,294 B2
(45) Date of Patent: Feb. 23, 2010

(54) DEPRESSED FREEZE POINT KEROSENE FUEL COMPOSITIONS AND METHODS OF MAKING AND USING SAME

(75) Inventors: Joanna Margaret Bauldreay, Chester (GB); Richard John Heins, Chester (GB); Johanne Smith, Chester (GB)

(73) Assignee: Shell Oil Company, Houston, TX (US)

( * ) Notice: Subject to any disclaimer, the term of this patent is extended or adjusted under 35 U.S.C. 154(b) by 560 days.

(21) Appl. No.: 10/942,439

(22) Filed: Sep. 16, 2004

(65) Prior Publication Data

US 2005/0109672 A1 May 26, 2005

(30) Foreign Application Priority Data

Sep. 17, 2003 (EP) ..... 03255837

(51) Int. Cl.
*C10L 1/04* (2006.01)
*C10L 1/16* (2006.01)

(52) U.S. Cl. ..... 208/15; 585/1; 585/14; 585/302; 208/93; 208/312; 44/300

(58) Field of Classification Search ..... 208/15, 208/93, 312; 585/14, 1, 302; 44/300
See application file for complete search history.

(56) References Cited

U.S. PATENT DOCUMENTS

| | | | | |
|---|---|---|---|---|
| 4,125,566 | A | 11/1978 | Trin Dinh et al. | 260/676 |
| 4,478,955 | A | 10/1984 | Pesa et al. | 518/713 |
| 6,180,842 | B1 * | 1/2001 | Berlowitz et al. | 585/1 |
| 6,846,402 | B2 * | 1/2005 | Hemighaus et al. | 208/14 |
| 6,860,909 | B2 * | 3/2005 | Berlowitz et al. | 44/436 |
| 2001/0015180 | A1 * | 8/2001 | Tinney | 123/1 A |
| 2003/0019788 | A1 * | 1/2003 | Benazzi et al. | 208/57 |
| 2003/0098261 | A1 * | 5/2003 | Bacha et al. | 208/170 |

FOREIGN PATENT DOCUMENTS

| | | |
|---|---|---|
| EP | 147873 | 7/1985 |
| EP | 583836 | 2/1994 |
| GB | 2077289 | 6/1980 |
| WO | 00/20535 | 4/2000 |
| WO | 00/60029 | 10/2000 |
| WO | 03/022960 | 3/2003 |
| WO | WO 2004/104142 A1 | 12/2004 |

OTHER PUBLICATIONS

Cookson D J et al:"Observed and predicted properties of Jet and Diesel Fules formulated from Coal Liquefaction and Fischer-Tropsch Feedstocks" Energy and Fuels, Washington D.C. US. vol. 6 No. 5 Sep. 1992 pp. 581-585, XP001096350 p. 582; tables I-V.

"The Shell Middle Distillate Synthesis Process", paper delivered at the 5$^{th}$ Synfuels Worldwide Symposium, Washington, DC, Nov. 1985.

Ministry of Defence Defence standard 91-91 Issue 4 Publication Date Jun. 14, 2002. Turbine Fuel, Aviation Kerosine Type, Jet A-1 NATO Code: F-35 Joint Service designation: AVTUR.

* cited by examiner

*Primary Examiner*—Walter D Griffin
*Assistant Examiner*—Natasha Young

(57) ABSTRACT

A fuel composition useful for operating a jet engine or a diesel engine containing a petroleum derived kerosene fuel and a Fischer-Tropsch derived kerosene fuel is provided. The Fischer-Tropsch derived kerosene fuel contains normal and iso-paraffins in a weight ratio of greater than 1:1 and/or the freeze point of the composition is lower than the freeze points of both of the petroleum derived kerosene fuel and the Fischer-Tropsch derived kerosene fuel.

28 Claims, 3 Drawing Sheets

DEPRESSED FREEZE POINT KEROSENE FUEL COMPOSITIONS AND METHODS OF MAKING AND USING SAME

FIELD OF THE INVENTION

The present invention relates to fuel compositions.

BACKGROUND OF THE INVENTION

The freeze point of a fuel composition is an important factor in determining whether it is suitable for use in power units which are intended for operation under low temperature conditions, such as for example arctic conditions. It is also an important factor in relation to aviation use, for which low temperature conditions are experienced at high altitudes. It is clearly vital that the fuel composition does not freeze or cause flow to be restricted (because of increased viscosity or blocked filters) during operation, otherwise the consequences could be disastrous.

Additives are known for inclusion in fuel compositions to enable them to be used under such low temperature conditions. Such additives include flow improver additives and wax anti-settling agents. However, it would be desirable to be able to achieve the low temperature effects of such additives whilst reducing, or even eliminating, their presence.

In "*Qualification of Sasol semi-synthetic Jet A-1 as commercial jet fuel", SwRI*-8531, Moses et al., November 1997, is described the blending into jet A-1 fuel of a synthetic iso-paraffinic kerosene (IPK), derived from synthesis gas through a Fischer-Tropsch process. IPK is described as having a very low freezing point, which is stated to be typically less than −60° C. Blends of 25% and 50% IPK in Jet A-1 are described as having freeze points of above −60° C., but below the freezing point of Jet A-1, which is indicated to be −47 to −49° C. Therefore, the freeze points of the blends lie between the respective freeze points of the blend components. This document also refers to the freeze points of blends of SMDS (i.e. Shell Middle Distillate Synthesis) kerosene with conventional fuels always being lower than predicted by blending ratio, i.e. below that according to a linear blending formula, but with no reference to where the freeze points of the blends lie in relation to the freeze points of the blend components. Therefore, from the disclosure of this document it would not be expected that the freeze point of blends would lie below the freeze points of both of the blend components.

In "*Freezing point of jet fuel blends", Schmidt, Minutes of the meeting of the low temperature flow performance of aviation turbine fuels group, CRC Aviation fuel, lubricant and equipment research meeting*, April 1995, there is discussion of the relationship of the measured freeze points of various jet fuel blends in relation to linear blending assumptions. It is shown in this document that said freeze points could be higher than or lower than the freeze points based on linear blending assumptions, and can be between the freeze points of the blending components or below the freeze points of both of the blend components. Thus, it is not possible to predict from this document what the relationship will be between the freeze point of a blend and the freeze points of the blend components, particularly of blends in which one of the components is a Fischer-Tropsch derived fuel, such fuels not being mentioned in this document.

SUMMARY OF THE INVENTION

In one embodiment, a fuel composition is provided comprising a petroleum derived kerosene fuel and a Fischer-Tropsch derived kerosene fuel, said Fischer-Tropsch derived kerosene fuel comprises normal and iso-paraffins in a weight ratio of greater than 1:1.

For another embodiment, a fuel composition is provided comprising a petroleum derived kerosene fuel and a Fischer-Tropsch derived kerosene fuel wherein the freeze point of the composition is lower than the freeze points of both of said petroleum derived kerosene fuel and said Fischer-Tropsch derived kerosene fuel.

In further embodiments, a method of preparing such fuels and a method of operating a jet engine or a fuel engine using such fuels are provided.

DETAILED DESCRIPTION OF THE INVENTION

Figure 1:
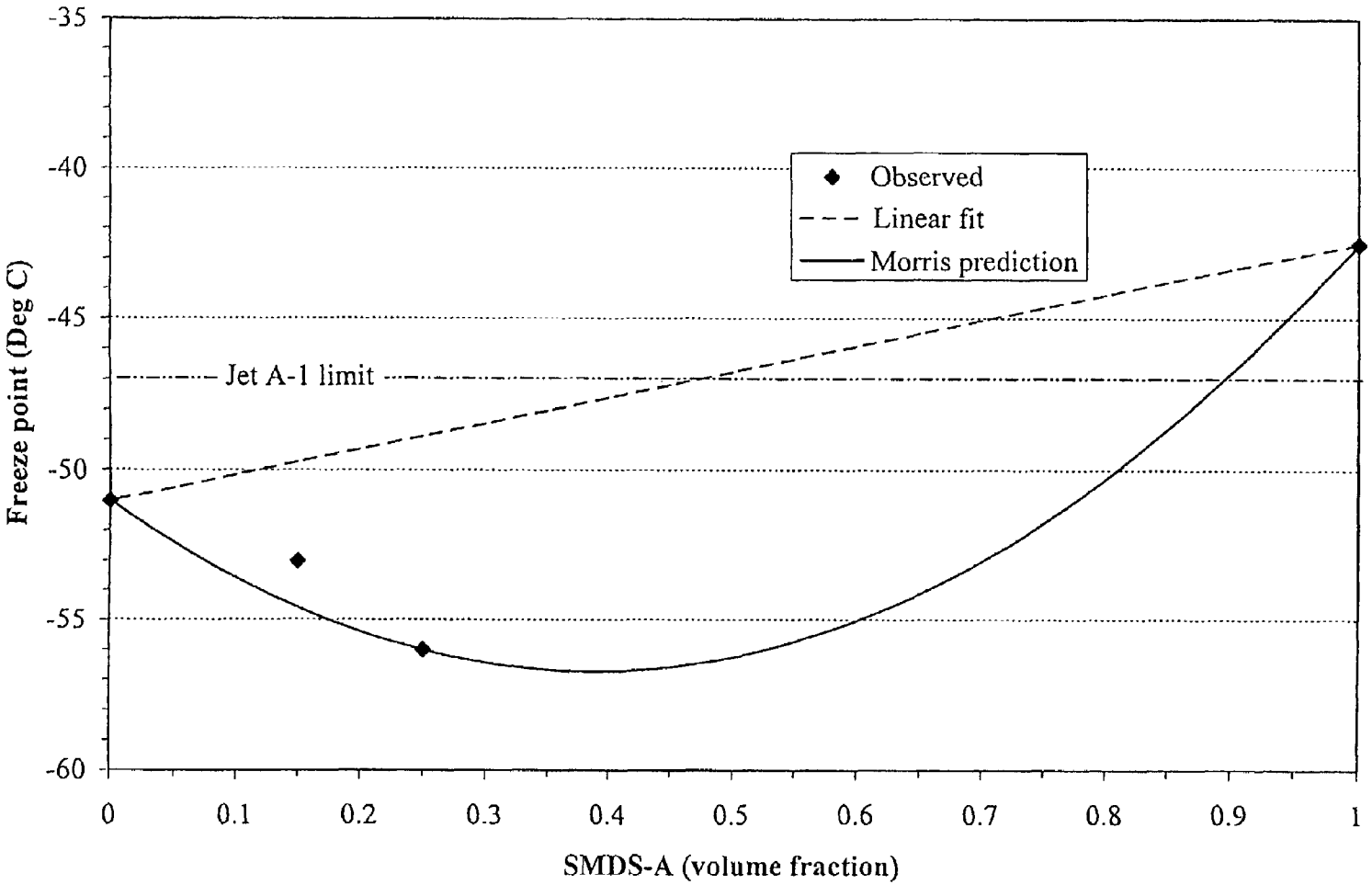
FIG. 1 shows the freezing point behaviour of blends of a Fischer-Tropsch derived kerosene fuel and petroleum derived kerosene fuel.

It has now been found that when blending certain Fischer-Tropsch derived kerosene fuels with petroleum derived kerosene fuels the freeze point of the blend is lower than the freeze points of both of the blend components.

According to the present invention there is provided a fuel composition comprising a petroleum derived kerosene fuel and a Fischer-Tropsch derived kerosene fuel, wherein said Fischer-Tropsch derived kerosene fuel contains normal and iso-paraffins in a weight ratio of greater than 1:1, and optionally wherein the freeze point of the composition is lower than the freeze points of both of said petroleum derived kerosene fuel and said Fischer-Tropsch derived kerosene fuel.

According to the present invention there is also provided a fuel composition comprising a petroleum derived kerosene fuel and a Fischer-Tropsch derived kerosene fuel wherein the freeze point of the composition is lower than the freeze points of both of said petroleum derived kerosene fuel and said Fischer-Tropsch derived kerosene fuel, and optionally wherein said Fischer-Tropsch derived kerosene fuel contains normal and iso-paraffins in a weight ratio of greater than 1:1.

Preferably, said ratio is in the range greater than 1:1 to 4:1, more preferably in the range greater than 1:1 to 3:1, most preferably in the range 1.5:1 to 3:1.

Preferably, said Fischer-Tropsch derived kerosene fuel is present in the fuel composition in the amount of 0.1 to 99.9% v, more preferably 0.1 to 81% v or 5 to 99.9% v, or most preferably 30 to 65% v.

The fuel composition comprising a petroleum based kerosene fuel of a Fischer-Tropsch derived kerosene fuel having a freeze point higher than that of the petroleum derived kerosene fuel can be used for the purpose of reducing the freeze point of the fuel composition below that of the petroleum derived kerosene fuel.

The fuel composition comprising a Fischer-Tropsch derived kerosene fuel of a petroleum derived kerosene fuel having a higher freeze point than that of the Fischer-Tropsch derived kerosene fuel can be used for the purpose of reducing the freeze point of the fuel composition below that of the Fischer-Tropsch derived kerosene fuel.

The Fischer-Tropsch derived kerosene fuel can be used as a freeze point depressant in a fuel composition.

The fuel composition of the invention can be used in power units. According to the present invention there is yet further provided a method of operating a jet engine or a diesel engine and/or an aircraft which is powered by one of more of said engines, which method involves introducing into said engine a fuel composition according to the present invention.

According to the present invention there is yet further provided a process for the preparation of a fuel composition which process involves blending a petroleum derived kerosene fuel with a Fischer-Tropsch derived kerosene fuel, said Fischer-Tropsch derived kerosene fuel containing normal and iso-paraffins in the ratio of greater than 1:1.

The present invention may be used to formulate fuel blends which are expected to be of particular use in modern commercially available aviation engines as alternatives to the standard aviation base fuels, for instance as commercial and legislative pressures favour the use of increasing quantities of synthetically derived fuels.

In the context of the present invention, "use" of a fuel component in a fuel composition means incorporating the component into the composition, typically as a blend (i.e. a physical mixture) with one or more other fuel components, conveniently before the composition is introduced into an engine.

The fuel compositions to which the present invention relates have use in aviation engines, such as jet engines or aero diesel engines, but also in any other suitable power source.

Each base fuel may itself comprise a mixture of two or more different fuel components, and/or be additivated as described below.

The kerosene fuels will typically have boiling points within the usual kerosene range of 130 to 300° C., depending on grade and use. They will typically have a density from 775 to 840 kg/m$^3$, preferably from 780 to 830 kg/m$^3$, at 15° C. (e.g. ASTM D4502 or IP 365). They will typically have an initial boiling point in the range 130 to 160° C. and a final boiling point in the range 220 to 300° C. Their kinematic viscosity at −20° C. (ASTM D445) might suitably be from 1.2 to 8.0 mm$^2$/s.

It may be desirable for the composition to contain 5% v or greater, preferably 10% v or greater, or more preferably 25% v or greater, of the Fischer-Tropsch derived fuel.

The Fischer-Tropsch derived fuel should be suitable for use as a kerosene fuel. Its components (or the majority, for instance 95% w or greater, thereof) should therefore have boiling points within the typical kerosene fuel range, i.e. from 130 to 300° C. It will suitably have a 90% v/v distillation temperature (T90) of from 180 to 220° C., preferably 180 to 200° C.

By "Fischer-Tropsch derived" is meant that the fuel is, or derives from, a synthesis product of a Fischer-Tropsch condensation process. The Fischer-Tropsch reaction converts carbon monoxide and hydrogen into longer chain, usually paraffinic, hydrocarbons:

$$n(CO+2H_2)=(—CH_2—)_n+nH_2O+\text{heat},$$

in the presence of an appropriate catalyst and typically at elevated temperatures (e.g. 125 to 300° C., preferably 175 to 250° C.) and/or pressures (e.g. 500 to 10000 kPa, preferably 1200 to 5000 kPa). Hydrogen:carbon monoxide ratios other than 2:1 may be employed if desired.

The carbon monoxide and hydrogen may themselves be derived from organic or inorganic, natural or synthetic sources, typically either from natural gas or from organically derived methane.

A kerosene product may be obtained directly from this reaction, or indirectly for instance by fractionation of a Fischer-Tropsch synthesis product or from a hydrotreated Fischer-Tropsch synthesis product. Hydrotreatment can involve hydrocracking to adjust the boiling range (see, e.g. GB-B-2077289 and EP-A-0147873) and/or hydroisomerisation which can improve base fuel cold flow properties by increasing the proportion of branched paraffins. EP-A-0583836 describes a two-step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired kerosene fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for example in U.S. Pat. No. 4,125,566 and U.S. Pat. No. 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for example in EP-A-0583836 (pages 3 and 4).

An example of a Fischer-Tropsch based process is the SMDS (Shell Middle Distillate Synthesis) described in "The Shell Middle Distillate Synthesis Process", van der Burgt et al (paper delivered at the 5$^{th}$ Synfuels Worldwide Symposium, Washington DC, November 1985; see also the November 1989 publication of the same title from Shell International Petroleum Company Ltd., London, UK). This process (also sometimes referred to as the Shell™ "Gas-to-Liquids" or "GTL" technology) produces middle distillate range products by conversion of a natural gas (primarily methane) derived synthesis gas into a heavy long-chain hydrocarbon (paraffin) wax which can then be hydroconverted and fractionated to produce liquid transport fuels such as kerosene fuel compositions. A version of the SMDS process, utilising a fixed-bed reactor for the catalytic conversion step, is currently in use in Bintulu, Malaysia and its products have been blended with petroleum derived gas oils in commercially available automotive fuels.

Gas oils prepared by the SMDS process are commercially available from the Royal Dutch/Shell Group of Companies.

Suitably, in accordance with the present invention, the Fischer-Tropsch derived kerosene fuel will consist of at least 90% w, preferably at least 95% w, more preferably at least 98% w, most preferably at least 99% w, of paraffinic components, preferably normal and iso-paraffins. The weight ratio of normal to iso-paraffins will preferably be in the ranges indicated above. The actual value for this ratio will be determined, in part, by the hydroconversion process used to prepare the kerosene from the Fischer-Tropsch synthesis product. Some cyclic paraffins may also be present.

By virtue of the Fischer-Tropsch process, a Fischer-Tropsch derived kerosene has essentially no, or undetectable levels of, sulphur and nitrogen. Compounds containing these heteroatoms tend to act as poisons for Fischer-Tropsch catalysts and are therefore removed from the synthesis gas feed. Further, the process as usually operated produces no or virtually no aromatic components. The aromatics content of a Fischer-Tropsch kerosene, as determined by ASTM D4629, will typically be below 5% w, preferably below 2% w and more preferably below 1% w.

The Fischer-Tropsch derived kerosene used in the present invention will typically have a density from 730 to 770 kg/m$^3$ at 15° C.; a kinematic viscosity from 1.2 to 6, preferably from 2 to 5, more preferably from 2 to 3.5, mm$^2$/s at −20° C.; and a sulphur content of 20 ppmw (parts per million by weight) or less, preferably of 5 ppmw or less.

Preferably it is a product prepared by a Fischer-Tropsch methane condensation reaction using a hydrogen/carbon monoxide ratio of less than 2.5, preferably less than 1.75, more preferably from 0.4 to 1.5, and ideally using a cobalt containing catalyst. Suitably it will have been obtained from a hydrocracked Fischer-Tropsch synthesis product (for instance as described in GB-B-2077289 and/or EP-A-0147873), or more preferably a product from a two-stage hydroconversion process such as that described in EP-A-0583836 (see above). In the latter case, preferred features of the hydroconversion process may be as disclosed at pages 4 to 6, and in the examples, of EP-A-0583836.

The finished fuel composition preferably contains no more than 3000 ppmw sulphur, more preferably no more than 2000 ppmw, or no more than 1000 ppmw, or no more than 500 ppmw sulphur.

The base fuel may itself be additivated (additive-containing) or unadditivated (additive-free). If additivated, e.g. at the refinery or in later stages of fuel distribution, it will contain minor amounts of one or more additives selected for example from anti-static agents (e.g. STADIS™ 450 (ex. Octel)), antioxidants (e.g. substituted tertiary butyl phenols), metal deactivator additives (e.g. N,N'-disalicylidene 1,2-propanediamine), fuel system ice improver additives (e.g. diethylene glycol monomethyl ether), corrosion inhibitor/lubricity improver additives (e.g. APOLLO™ PRI 19 (ex. Apollo), DCI 4A (ex. Octel), NALCO™ 5403 (ex. Nalco)), or thermal stability improving additives (e.g. APA 101™, (ex. Shell)) that are approved in international civil and/or military jet fuel specifications.

Unless otherwise stated, the (active matter) concentration of each such additional component in the additivated fuel composition is at levels required or allowed in international jet fuel specifications.

In this specification, amounts (concentrations, % v, ppmw, wt %) of components are of active matter, i.e. exclusive of volatile solvents/diluent materials.

The present invention is particularly applicable where the fuel composition is used or intended to be used in a jet engine, a direct injection diesel engine, for example of the rotary pump, in-line pump, unit pump, electronic unit injector or common rail type, or in an indirect injection diesel engine. It may be of particular value for rotary pump engines, and in other diesel engines which rely on mechanical actuation of the fuel injectors and/or a low pressure pilot injection system. The fuel composition may be suitable for use in heavy and/or light duty diesel engines.

The present invention may lead to any of a number of advantageous effects, including good engine low temperature performance.

EXAMPLES

The present invention will now be described by way of example and with reference to the accompanying drawings. The drawings and examples are not intended to limit the invention to the particular form disclosed, but, the invention is to cover all modifications, equivalents, and alternates falling within the scope of the invention as defined by the claims.

Figure 2:
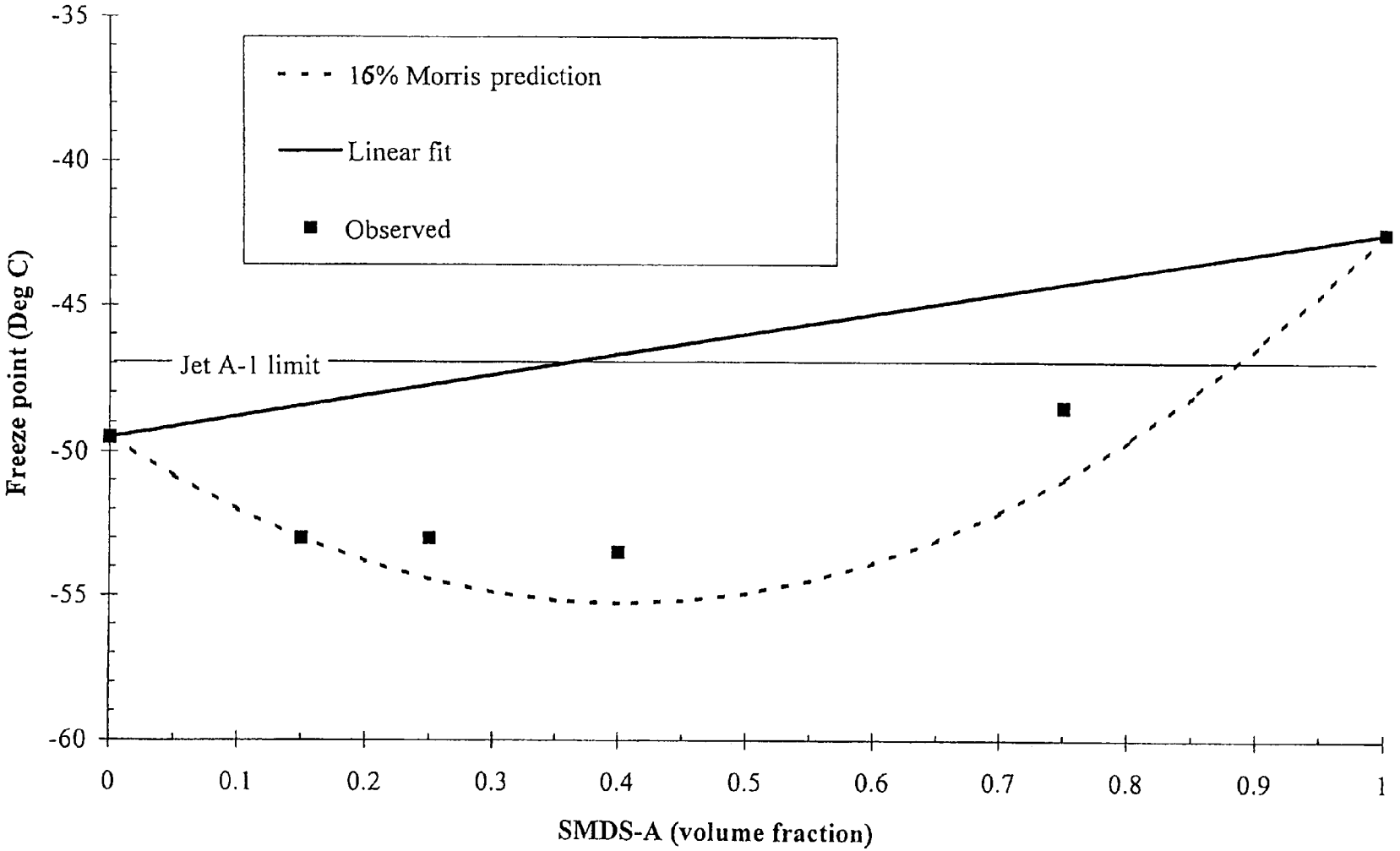
FIG. 2 shows the freezing point behaviour of another blend of a Fischer-Tropsch derived kerosene fuel and petroleum derived kerosene fuel.
Figure 3:
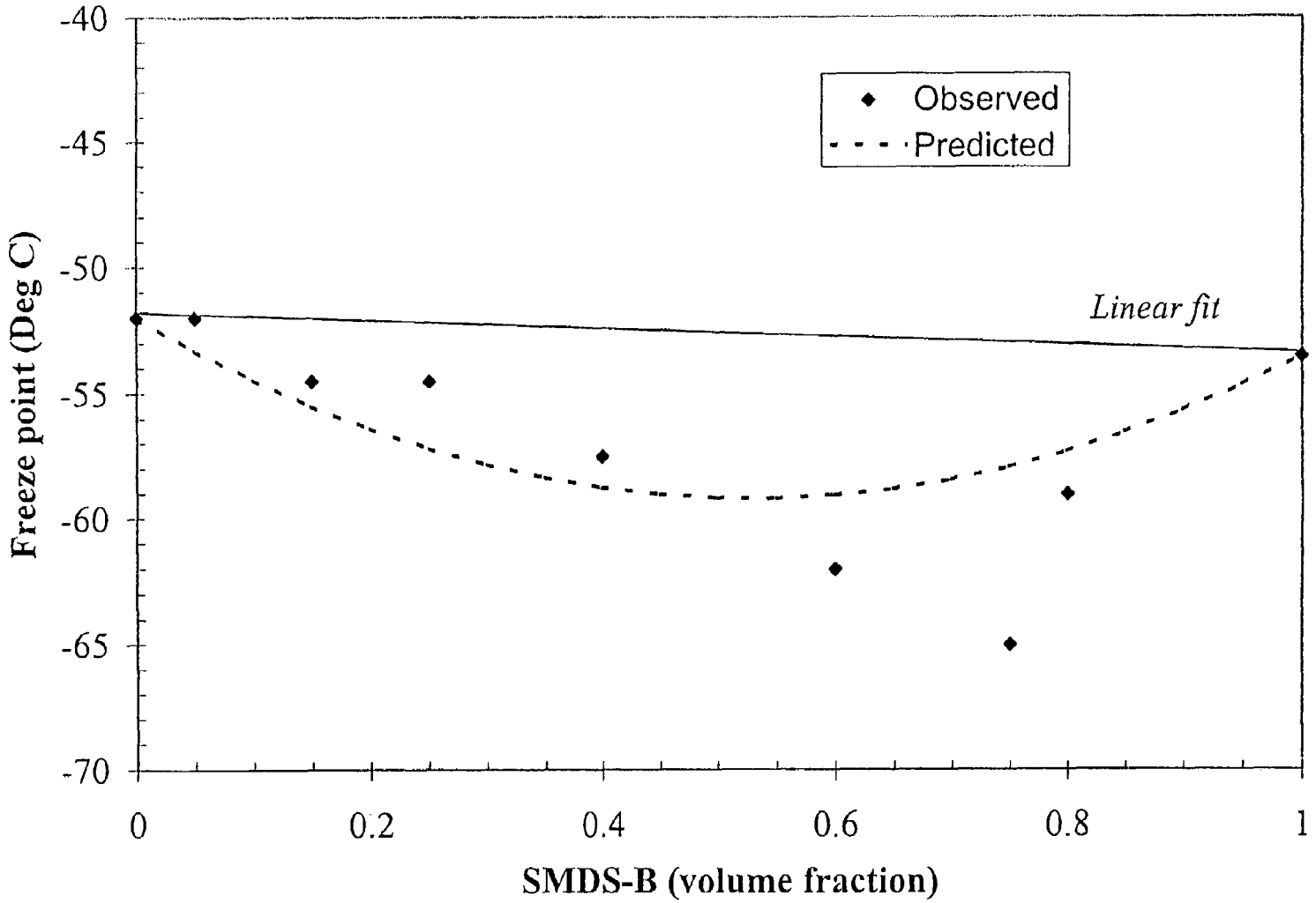
FIG. 3 shows the freezing point behaviour of yet another a Fischer-Tropsch derived kerosene fuel and petroleum derived kerosene fuel.

FIG. 1 shows the freeze point behaviour of blends of SMDS-A and jet fuel J1;

FIG. 2 shows the freeze point behaviour of blends of SMDS-A and jet fuel J2; and FIG. 3 shows the freeze point behaviour of blends of SMDS-B and jet fuel J3.

The effect of Fischer-Tropsch, i.e. SMDS, derived kerosenes on the freeze points of kerosene blends was assessed using the manual freeze point procedure required in international jet fuel specifications, ASTM D2386/IP 16.

Two SMDS kerosenes, each containing approved jet fuel antioxidant at approximately 20 mg/L, and five petroleum, i.e. crude oil, derived kerosenes were chosen to explore the effects. Details of these petroleum derived kerosenes, i.e. four finished jet fuels, made by typical production routes and meeting Jet A-1 requirements in DEF STAN 91-91 (British Ministry of Defence Standard DEF STAN 91-91/Issue 4 of 14 Jun. 2002 for Turbine Fuel, Aviation "kerosene type", Jet A-1, NATO code F-35, Joint Service Designation AVTUR, or versions current at the time of testing) or "Check List" (Aviation Fuel Quality Requirements for Jointly Operated Systems represent the most stringent elements of ASTM D1655 for Jet A-1 and DEF STAN 91-91 and some airport handling requirements of the IATA Guidance Material for Aviation Turbine Fuel "Kerosine Type Fuel". Jet fuel that meets the AFQRJOS is usually referred to as "Jet A-1 to Check List".), and a kerosene stream used in Jet A-1 production, are listed in Table 1.

TABLE 1

| Fuel | Description |
|---|---|
| J1 | Jet fuel produced by Merox ® process. |
| J2 | Hydroprocessed jet fuel, with 19 mg/L of antioxidant Ionox 75 (RDE/A/609). |
| J3 | Jet fuel produced by caustic washing of straight run kerosene. |
| J4 | Jet fuel produced by Merox ® process. |
| S1 | Straight run kerosene stream. |

Key properties of the SMDS fuels and petroleum derived fuels, measured using ASTM and IP methods approved in jet fuel specifications, are listed in Tables 2 and 3, respectively. Both SMDS kerosene samples were narrow cut kerosenes, compared to a more typical boiling range of 130 to 260° C. for Jet A-1. SMDS-A would fail a Jet A-1 freeze point requirement (−47° C., maximum) whereas SMDS-B would pass. Both were highly paraffinic (greater than 98% paraffins, mainly normal paraffin, and approximately 0.9% naphthenes (cycloparaffins)) fuels, and whilst the two samples had compositional differences, neither was highly iso-paraffinic (weight ratio of normal to iso-paraffins: SMDS-A =2.7:1, SMDS-B=1.9:1) nor had significant amounts of aromatics.

TABLE 2

| | SMDS-A | SMDS-B |
|---|---|---|
| Total acidity, mg KOH/g | 0.001 | <0.001 |
| FIA Aromatics, % v | <0.1 | <0.1 |
| Total sulphur, % m | 0.00008 | 0.00090 |
| Mercaptan sulphur, % m | 0.0001 | 0.0002 |
| Distillation | | |
| Initial Boiling Point, ° C. | 162.0 | 152.5 |
| 10% recovery, ° C. | 176.0 | 159.5 |
| 50% recovery, ° C. | 184.0 | 167.0 |
| 90% recovery, ° C. | 192.0 | 185.5 |
| Final Boiling Point, ° C. | 203.5 | 208.0 |
| Abel flash point, ° C. | 48.5 | 42.0 |
| Density @ 15° C., kg/m$^3$ | 742.1 | 736.1 |
| Freeze point, ° C. | −42.5 | −53.5 |
| Viscosity @ −20° C., mm$^2$/s | 3.144 | 2.474 |
| Specific energy, MJ/kg | 44.176 | 44.176 |
| Smoke point, mm | >50 | >50 |
| Existent gum, mg/100 ml | <1 | <1 |
| MSEP | 96 | 99 |

TABLE 3

| | J1 | J2 | J3 | J4 | S1 |
|---|---|---|---|---|---|
| Total Acidity, mg KOH/g | 0.003 | 0.001 | 0.004 | 0.001 | 0.063 |
| FIA Aromatics, % v | 18.4 | 17.4 | 19.6 | 18.1 | 21.9 |
| Total sulphur, % m | 0.0298 | 0.01 | 0.0091 | 0.23 | 0.06 |
| Mercaptan sulphur, % m | 0.0003 | 0.0002 | 0.0001 | 0.0012 | 0.0003 |
| Distillation | | | | | |
| Initial Boiling Point, ° C. | 148.0 | 153 | 147.0 | 165.6 | 155.3 |
| Final Boiling Point, ° C. | 256.5 | 256 | 258.5 | 246.6 | 263.7 |
| Density @ 15° C., kg/m$^3$ | 799.6 | 788.8 | 800.8 | 797.1 | 827.5 |
| Freeze point, ° C. | −51 | −49.5 | −52 | −53 | −61 |
| Smoke Point, mm | 24 | 26 | 24 | 23 | 19 |
| Naphthalenes, % v | 2.12 | 0.57 | 2.33 | 2.4 | 3.06 |
| Specific Energy, MJ/kg | 43.243 | 43.4 | 43.211 | 43.3 | 42.9 |

At least one blend per fuel combination was prepared by measuring known volumes of the component fuels into lacquer-lined containers suitable for storage of jet fuels. Freeze points and density measurements were made, the latter being to confirm the exact compositions of the blends.

Example 1

Blends were prepared with SMDS-A and jet fuel J1. Measured properties are provided in Table 4 and show that the blend freeze points, $FP_{measured}$, were lower (better) than expected on the basis of a simple linear blending rule:

$$FP_{linear}=a_1X_1+a_2X_2 \quad (1)$$

where $a_1$=freeze point of component 1, $a_2$=freeze point of component 2, $X_1$=volume fraction of component 1 and $X_2$=volume fraction of component 2. The maximum measured deviation from the linear blend model was 7.0° C. This non-linearity indicates that more than the 45-50% v SMDS-A expected could be incorporated into a blend with J1 to produce fuels that met the −47° C. maximum requirement for Jet A-1 (DEF STAN 91-91 and AFQRJOS). More surprisingly, the measured freeze points of most of the blends were lower than those of either of the base fuels used in the blend.

TABLE 4

| Volume fraction SMDS-A | Density at 15° C., kg/m$^3$ | Measured freeze point, ° C. ($FP_{measured}$) | Freeze point from linear model, ° C. ($FP_{linear}$) | $FP_{linear}-FP_{measured}$, ° C. |
|---|---|---|---|---|
| 0.00 | 799.6 | −51.0 | −51.0 | 0.0 |
| 0.16 | 790.3 | −53.0 | −49.6 | 3.4 |
| 0.24 | 785.8 | −56.0 | −49.0 | 7.0 |
| 1.00 | 742.1 | −42.5 | −42.5 | 0.0 |

Fits to the data were obtained using Morris blending interaction equations:

$$FP_{Morris}=a_1X_1+a_2X_2+b_{12}X_1X_2 \quad (2)$$

where $a_i$=freeze point of component i, $X_i$=volume fraction of component i, and $b_{12}$=interaction coefficient. FIG. 1 shows the measured freeze points and includes predictions both from the linear model and from the Morris interaction equation using the 25% volume SMDS-A data point to calculate $b_{12}$. From this Morris prediction, almost 90% SMDS-A could be accommodated and still pass Jet A-1 freeze point requirements. The fit also indicates that blends with between 0 and 81% SMDS-A have freeze points lower than that of J1, the lower freeze point component. The maximum deviation from linearity, according to this fit, could be up to 9.5° C.

Example 2

Blends were prepared with SMDS-A and hydroprocessed jet fuel J2. Table 5 summarises the measured properties and also indicates how the data compared with a linear freeze point model. Positive (better) deviations from the linear model were seen for all the blends prepared, the largest measured difference being nearly 7° C.

TABLE 5

| Volume fraction SMDS-A | Density at 15° C., kg/m$^3$ | Measured freeze point, ° C. ($FP_{measured}$) | Freeze point from linear model, ° C. ($FP_{linear}$) | $FP_{linear}-FP_{measured}$, ° C. |
|---|---|---|---|---|
| 0.00 | 788.8 | −49.5 | −49.5 | 0 |
| 0.16 | 781.4 | −53 | −48.4 | 4.6 |
| 0.25 | 777.3 | −53 | −47.8 | 5.2 |
| 0.39 | 770.4 | −53.5 | −46.8 | 6.7 |

TABLE 5-continued

| Volume fraction SMDS-A | Density at 15° C., kg/m$^3$ | Measured freeze point, ° C. ($FP_{measured}$) | Freeze point from linear model, ° C. ($FP_{linear}$) | $FP_{linear}$ − $FP_{measured}$, ° C. |
|---|---|---|---|---|
| 0.74 | 754.4 | −48.5 | −44.3 | 4.2 |
| 1.00 | 742.1 | −42.5 | −42.5 | 0 |

A Morris interaction coefficient was calculated for the composition with one of the smallest measured deviations from the linear model, i.e. the 16% blend. FIG. 2 shows the measured data, the linear prediction and also the fit of the data by the Morris interaction coefficient approach. Said fit gives lowest freeze points for blends with 35 to 45% SMDS, with the maximum predicted deviation from linearity being up to 9.2° C. A linear blending rule would predict that blends containing 35% or more SMDS would fail the Jet A-1 specification limit; the Morris interaction coefficient fit suggests that the level could be as high as 88%. It also indicates that blends with between 0 and 81% SMDS-A would have freeze points lower than that of either SMDS-A or J2.

Example 3

Blends were prepared with SMDS-B and jet fuel J3, and had measured properties as summarised in Table 6. The two base fuels had similar freeze points. Except for the 5% SMDS-B case, all blends had freeze points better than (lower than) predicted by a linear model and which were lower than that of SMDS-B, the lower freeze point component. The largest measured deviation from linearity was 11.9° C. Taking all the data points, an optimised $b_{12}$ coefficient was calculated and used to fit the data as shown in FIG. 3.

TABLE 6

| Volume fraction SMDS-B | Density at 15° C., kg/m$^3$ | Measured freeze point, ° C. ($FP_{measured}$) | Freeze point from linear model, ° C. ($FP_{linear}$) | $FP_{linear}$ − $FP_{measured}$, ° C. |
|---|---|---|---|---|
| 0.000 | 800.8 | −52.0 | −52.0 | 0 |
| 0.05 | 797.6 | −52.0 | −52.1 | −0.1 |
| 0.15 | 791.2 | −54.5 | −52.2 | 2.8 |
| 0.25 | 784.8 | −54.5 | −52.4 | 2.1 |
| 0.39 | 775.3 | −57.5 | −52.6 | 4.9 |
| 0.60 | 762.4 | −62.0 | −52.9 | 9.1 |
| 0.75 | 752.6 | −65.0 | −53.1 | 11.9 |
| 0.80 | 749.0 | −59.0 | −53.2 | 5.8 |
| 1.000 | 736.1 | −53.5 | −53.5 | 0 |

Example 4

A single blend was prepared with SMDS-B and jet fuel J4, fuels with freeze points that are not significantly different from one another. The positive deviation between a linear model and actual freeze point was just over 4° C.

TABLE 7

| Volume fraction SMDS-B | Density at 15° C., kg/m$^3$ | Measured freeze point, ° C. ($FP_{measured}$) | Freeze point from linear model, ° C. ($FP_{linear}$) | $FP_{linear}$ − $FP_{measured}$, ° C. |
|---|---|---|---|---|
| 0.00 | 797.1 | −53.0 | −53.0 | 0 |
| 0.30 | 778.6 | −57.5 | −53.2 | 4.3 |
| 1.00 | 736.1 | −53.5 | −53.5 | 0 |

Example 5

A single blend was prepared with SMDS-B and straight run kerosene S1, the latter having the better (lower) freeze point. Table 8 shows that the positive deviation between a linear model and actual freeze point was 12.7° C., and the blend's freeze point was 9° C. lower than that of the neat S1.

TABLE 8

| Volume fraction SMDS-B | Density at 15° C., kg/m$^3$ | Measured freeze point, ° C. ($FP_{measured}$) | Freeze point from linear model, ° C. ($FP_{linear}$) | $FP_{linear}$ − $FP_{measured}$, ° C. |
|---|---|---|---|---|
| 0.00 | 827.5 | −61.0 | −61.0 | 0 |
| 0.50 | 782.2 | −70.0 | −57.3 | 12.7 |
| 1.00 | 736.1 | −53.5 | −53.5 | 0 |

The above Examples have shown that there are blends of Fischer-Tropsch derived kerosenes and petroleum derived kerosenes that exhibit freeze points that are lower than those of both blend components. This has been observed for both kerosenes SMDS-A and SMDS-B, which have significantly different freeze points from one another. It has been seen for systems where the Fischer-Tropsch derived kerosene has the lower or the higher freeze point of the two components. These non-linearities and improvements compared with starting materials are not expected.

Thus, introducing a Fischer-Tropsch derived kerosene into a petroleum derived kerosene such as a jet fuel could provide low temperature flow fuels without the need for the addition of flow-improving or wax anti-settling additives. It would be an easier blending operation (no heat required) and could produce fuels without the tendency to foul up engine systems at low operating temperatures. The fuels would also have built-in combustion and emission improving capabilities.

We claim:

1. A kerosene fuel composition having a depressed freeze point comprising:

a quantity of petroleum derived kerosene fuel having a boiling point of from 130 to 300° C.; and, an amount of greater than 0 vol. % to about 81 vol. % Fischer-Tropsch derived kerosene fuel comprising 90% w or more normal and iso-paraffins in a weight ratio of greater than 1:1 and having a boiling point of from 130 to 300° C.;

wherein the amount of the Fischer-Tropsch derived kerosene fuel is effective, even absent a flow improver additive or wax anti-settling agent, to produce the kerosene fuel composition having the depressed freeze point that is lower than both the freeze point of the petroleum derived kerosene fuel and the freeze point of the Fischer-Tropsch derived kerosene fuel.

2. The kerosene fuel composition of claim 1 wherein the depressed freeze point is at or below a designated freeze point limit for the kerosene fuel composition.

3. The kerosene fuel composition of claim 1 wherein the amount of Fischer-Tropsch derived kerosene fuel is from about 0.1 vol. % to about 81 vol. %.

4. The kerosene fuel composition of claim 3 wherein the amount of Fischer-Tropsch derived kerosene fuel is from about 0.1 vol. % to about 81 vol. %.

5. The kerosene fuel composition of claim 1 wherein the Fischer-Tropsch derived kerosene fuel contains normal and iso-paraffins in a weight ratio of from greater than 1:1 to 4:1.

6. The kerosene fuel composition of claim 3 wherein the Fischer-Tropsch derived kerosene fuel contains normal and iso-paraffins in a weight ratio of from greater than 1:1 to 4:1.

7. The kerosene fuel composition of claim 1 wherein the Fischer-Tropsch derived kerosene fuel contains normal and iso-paraffins in a weight ratio of from greater than 1:1 to 3:1.

8. The kerosene fuel composition of claim 3 wherein the Fischer-Tropsch derived kerosene fuel contains normal and iso-paraffins in a weight ratio of from greater than 41-1 .5 to 3:1.

9. The kerosene fuel composition of claim 1 wherein the amount of Fischer-Tropsch derived kerosene fuel is about 70 vol. % or less.

10. The kerosene fuel composition of claim 1 wherein the amount of Fischer-Tropsch derived kerosene fuel is from about 30 vol. % to about 65 vol. %.

11. The kerosene fuel composition of claim 1 comprising a jet fuel composition.

12. The kerosene fuel composition of claim 2 comprising a jet fuel composition.

13. A method of operating an engine selected from the group consisting of a jet engine and an aerodiesel engine, the method comprising introducing the kerosene fuel composition of claim 1 into the engine.

14. The method of claim 13 wherein the depressed freeze point is at or below a designated freeze point limit for the kerosene fuel composition.

15. The method of claim 14 comprising introducing the kerosene fuel composition into a jet engine.

16. The method of claim 15 comprising introducing the kerosene fuel composition into an aero diesel.

17. The method of claim 14 comprising introducing the kerosene fuel composition into an aero diesel engine.

18. A process for depressing the freeze point of a kerosene fuel composition, the process comprising blending a petroleum derived kerosene fuel having a boiling point of from 130 to 300° C. with an amount of greater than 0 vol. % to about 81 vol. % Fischer-Tropsch derived kerosene fuel comprising 90% w or more normal and iso-paraffins in a weight ratio of greater than 1:1 and having a boiling point of from 130 to 300° C. to produce the kerosene fuel composition, the amount of Fischer-Tropsch derived kerosene fuel being sufficient, even absent a flow improver additive or wax anti-settling agent, to produce the kerosene fuel composition having a depressed freeze point that is lower than both the freeze point of the Fischer Tropsch derived kerosene fuel and the freeze point of the petroleum derived kerosene fuel.

19. The process of claim 18 wherein the depressed freeze point is at or below a designated freeze point limit for the kerosene fuel composition.

20. The process of claim 19 wherein the Fischer-Tropsch derived kerosene fuel contains normal and iso-paraffins in a weight ratio of from greater than 1:1 to 4:1.

21. The process claim 19 wherein the Fischer-Tropsch derived kerosene fuel contains normal and iso-paraffins in a weight ratio of from greater than 1:5 to 3:1.

22. The process of claim 18 wherein the amount of Fischer-Tropsch derived kerosene fuel is from about 0.1 to about 81 vol. %.

23. The process of claim 19 wherein the amount of Fischer-Tropsch derived kerosene fuel is from about 0.1 to about 81 vol. %.

24. The process of claim 21 wherein the amount of Fischer-Tropsch derived kerosene fuel is from about 0.1 to about 81 vol. %.

25. The process of claim 18 wherein the amount of Fischer-Tropsch derived kerosene fuel is about 70 vol. % or less.

26. The process of claim 18 wherein the amount of Fischer-Tropsch derived kerosene fuel is from about 30 vol. % to about 65 vol. %.

27. The process of claim 18 further comprising introducing the kerosene fuel composition into a jet engine.

28. The process of claim 18 further comprising introducing the kerosene fuel composition into an aero diesel engine.

* * * * *